United States Patent [19]

Bailet et al.

[11] Patent Number: 4,819,570

[45] Date of Patent: Apr. 11, 1989

[54] STRONGBOX HAVING AN INTEGRAL ANTITHEFT MECHANISM

[76] Inventors: Melvin E. Bailet, 320 W. Prospect St., Seattle, Wash. 98119; Kenneth W. Fane, 3160 W. King Edward Ave., Vancouver, Canada, V6L 1V5

[21] Appl. No.: 122,643

[22] Filed: Nov. 10, 1987

Related U.S. Application Data

[63] Continuation of Ser. No. 859,908, May 5, 1986, abandoned.

[51] Int. Cl.[4] ..... E05G 3/00; E05G 1/00

[52] U.S. Cl. ..... 109/23; 109/44; 109/45

[58] Field of Search ..... 109/3, 23, 45, 44, 1 R, 109/36; 70/226, 227

[56] References Cited

U.S. PATENT DOCUMENTS

| | | | |
|---|---|---|---|
| 1,487,480 | 3/1924 | Scherer | 70/227 |
| 3,120,202 | 2/1964 | Fisher | 109/23 |
| 3,762,345 | 10/1973 | Sgariglia, Jr. | 109/23 |
| 4,366,997 | 1/1983 | Lopez et al. | 109/45 |

*Primary Examiner*—Neill R. Wilson

*Attorney, Agent, or Firm*—Finnegan, Henderson, Farabow, Garrett & Dunner

[57] ABSTRACT

A strongbox having an integral antitheft mechanism. The antitheft mechanism is a plurality of rigid rod-like projections having a normal retracted position within a perimeter of the strongbox. The projections are maintained in this normal position by a lever which is associated with a handle for gripping to move the strongbox. If the manual lever is released actuating means provide for the rapid movement of the projections from the retracted position to a radial, extended position beyond the strongbox perimeter. These projections when in the extended position impair movement of the strongbox.

14 Claims, 7 Drawing Sheets

STRONGBOX HAVING AN INTEGRAL ANTITHEFT MECHANISM

This application is a continuation of application Ser. No. 859,908, filed May 5, 1986, now abandoned.

BACKGROUND OF THE INVENTION

Portable strongboxes are provided for transporting valuables from one location to another. This includes the transport of valuables from armored delivery vehicles to and from safe rooms within buildings serviced by the armored vehicle. In these applications, guards transport the valuables on foot from the armored vehicle through public areas and to the safe room. During the transport through public areas between the armored vehicle and the safe room, the valuables are carried usually within fabric bags. While in the public areas, the maximum jeopardy for attack and robbery of the valuables being transported occurs. Since the fabric bags in which the valuables are transported lend themself to movement by an individual carrier, a robber once in possession of these bags can easily escape with them.

It is accordingly a primary object of the present invention to provide a strongbox adapted for manual transport that when out of the grasp of the authorized person transporting the strongbox an antitheft mechanism will be activated which impairs movement of the strongbox.

A more specific object of the invention is a strongbox wherein an antitheft mechanism when activated renders the strongbox incapable of being moved through doorways and along stairways or the like; in addition, the antitheft mechanism when actuated renders the strongbox difficult to grasp, carry or otherwise transport.

BRIEF DESCRIPTION OF THE DRAWINGS

The accompanying drawings, which are incorporated in and constitute a part of this specification, illustrate embodiments of the invention and, together with the description, serve to explain the principles of the invention.

SUMMARY OF THE INVENTION

The invention is a strongbox having an integral antitheft mechanism. The strongbox comprises a container having an interior adapted for storing valuables and a lid for selectively opening and closing the container interior to allow loading and unloading of valuables. A locking means is associated with the lid and is adapted to lock the lid in the closed position. At least one rigid, rod-like projection having a normal, retracted position within a perimeter of the strong box is provided along with actuating means for rapid movement of the projections from the retracted position to a radial, extended position beyond the strongbox perimeter. This prevents unauthorized transport of the strongbox. Manually operable means are provided for activating said actuating means for movement of a projection from the retracted position to the radial, extended position. The manually operable activating means may be a hand-held lever which when released from a hand-held, depressed position activates the actuating means to result in the rapid movement of a projection from the retracted position to the radial, extended position. A dolly may be integral with the strongbox with the dolly having a pair of wheels. At least one projection is adapted to extend through an opening in at least one wheel when in the extended position. This prevents rotation of the wheel and thus impairs unauthorized movement of the strongbox. Latching means may be provided for selectively maintaining the hand-held lever in the depressed position in the absence of manual operation to maintain the lever depressed. The latching means may be selectively activated and deactivated by a key. The hand-held lever may be attached to the lid of the strongbox and may be in hand-held relation to a carrying handle attached to the lid. If a dolly is provided integral with the strongbox it may have a handle extending from the container of the strongbox and the hand-held lever may be attached to this handle.

DESCRIPTION OF THE PREFERRED EMBODIMENTS

Figure 1:
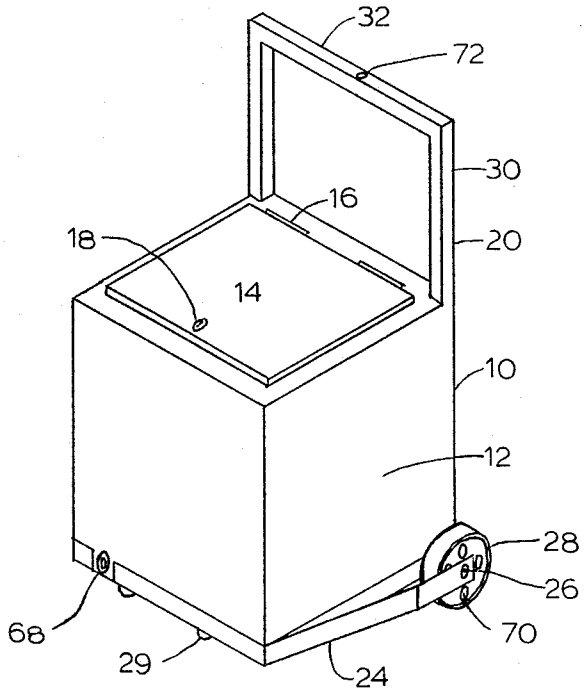
FIG. 1 is a perspective view of one embodiment of a strongbox in accordance with the invention.

With reference to FIG. 1 of the drawings there is shown a strongbox in accordance with the invention, designated generally as 10. The strongbox has a container 12 of generally rectangular cross section with a lid 14 connected to the container 12 by hinges 16 which permit the lid to be raised and lowered. A key operated lock 18 is provided in the lid 14. The container 12 is connected by means not shown which may be bolting, welding and the like, to a dolly 20. The dolly 20 includes a base 22 on which container 12 rests and axle mounting brackets 24 through which an axle 26 extends. A pair of wheels 28 are journalled for rotation on axle 26 on opposite sides of the container 12. Two casters 29 are provided to facilitate movement of the strongbox.

The dolly also includes an upstanding handle 30 having a horizontal grip bar 32.

Figure 3:
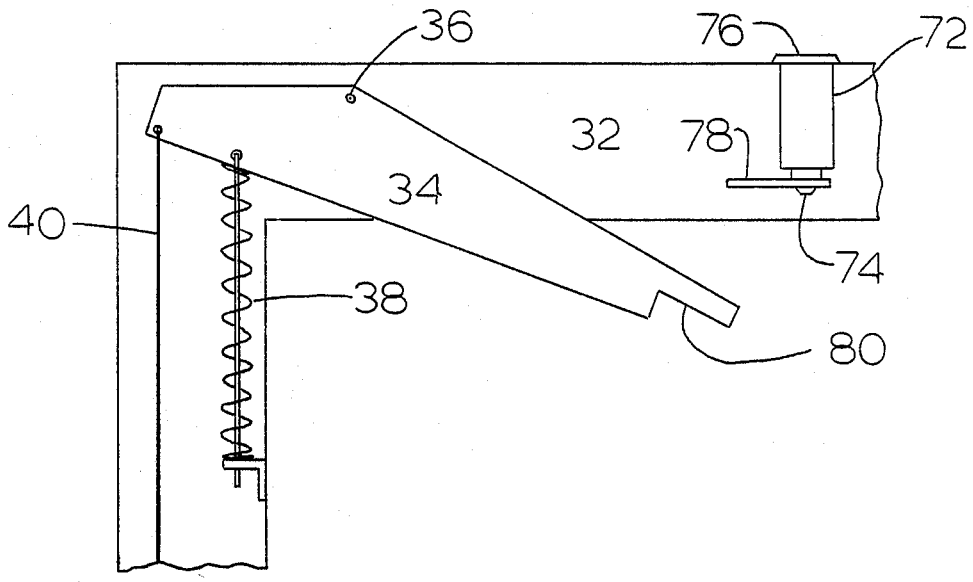
FIG. 3 is a detailed view of a portion of the strongbox of the invention and specifically showing the manually operated lever in position causing actuation of the antitheft mechanism.
Figure 5:
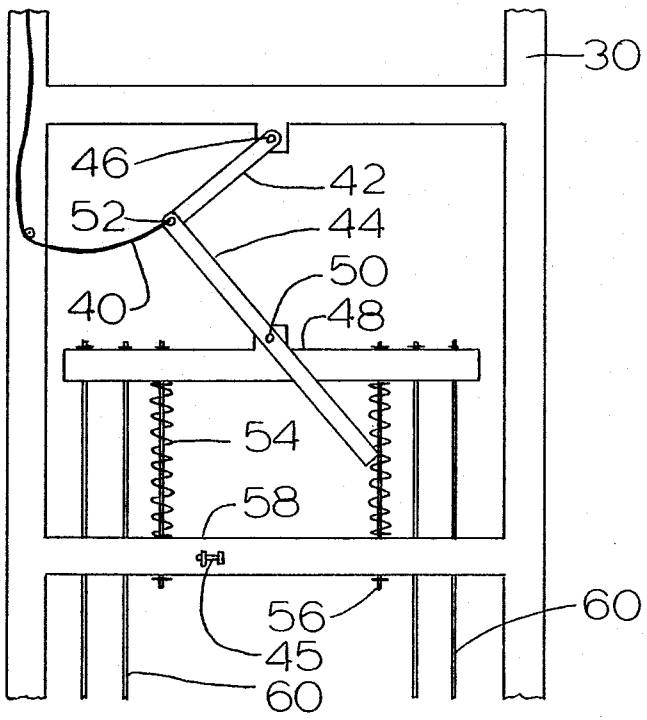
FIG. 5 is a view identical to that of FIG. 4 except with the antitheft mechanism in the actuated position.
Figure 4:
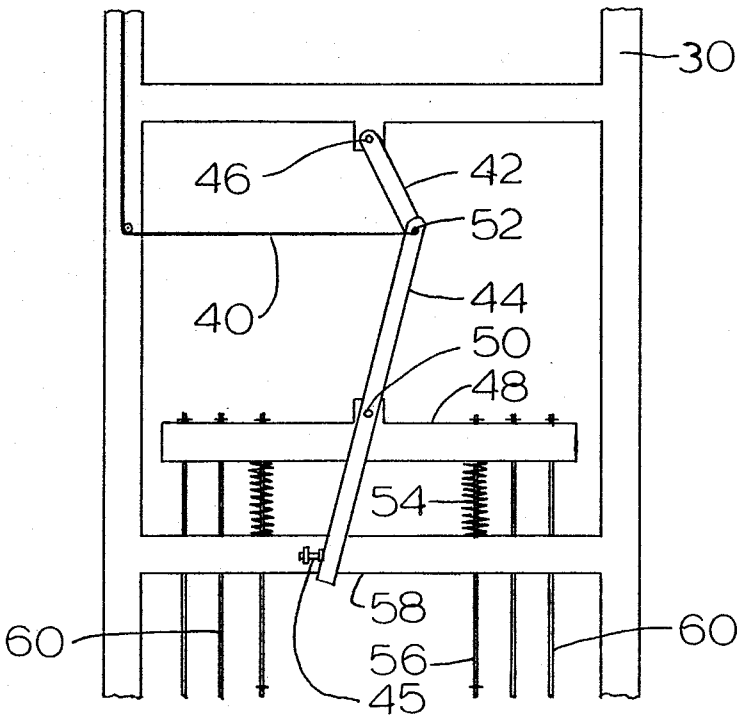
FIG. 4 is a detailed view showing the antitheft mechanism in the normal, deactivated position.

As shown in FIG. 3, the grip bar 32 of handle 30 has a lever 34 constituting what is known as a dead-man's switch. The lever 34 is pivotally connected to the handle at pivot connector 36. Spring 38 normally biases the handle 34 to the ungripped position shown in FIG. 3. When the handle is gripped it is pivoted at 36 to a position parallel to the handle 32 and against the bias of spring 38. A cable 40 is connected at one end of the lever 34. As shown in FIGS. 4 and 5, the cable is also connected to pivot links 42 and 44. Pivot link 42 is pivotally connected at pivot connector 46 to the handle 30 of the dolly and pivot link 44 is connected to a lift bar 48 by pivot connector 50. Pivot links 42 and 44 are pivotally connected at their adjacent ends by pivot connector 52 to which an end of cable 40 is also connected. The free end of pivot link 44 when the mechanism is in the deactivated position, as shown in FIG. 4, rests against stop 45. With the lever 34 in the ungripped position, which is the position shown in FIG. 3, the cable 40 is in the raised position and the pivot links 42 and 44 and associated lift bar 48 are in the position shown in FIG. 4. A pair of springs 54 are mounted on spring-retainer rods 56. The spring retainer rods 56 extend through and are rigidly attached to lift bar 48 and slidably extend through cross member 58 of the handle 30. The springs 54 with the lever 34 in the gripped position are compressed between cross member 58 and lift bar 48, as shown in FIG. 4. Four identical actuator rods 60 are also connected to lift bar 48 and extend through the cross member 58. The actuator rods 60 are adapted for sliding, longitudinal movement through the cross member 58. Stop 45 is connected to cross member 58.

With the lever 34 in the ungripped position shown in FIG. 3, the pivot links 42 and 44, associated lift bar 48 and the actuator rods 60 are in the positions shown in FIG. 5. In this position, the antitheft mechanism of the invention is actuated.

Figure 2:
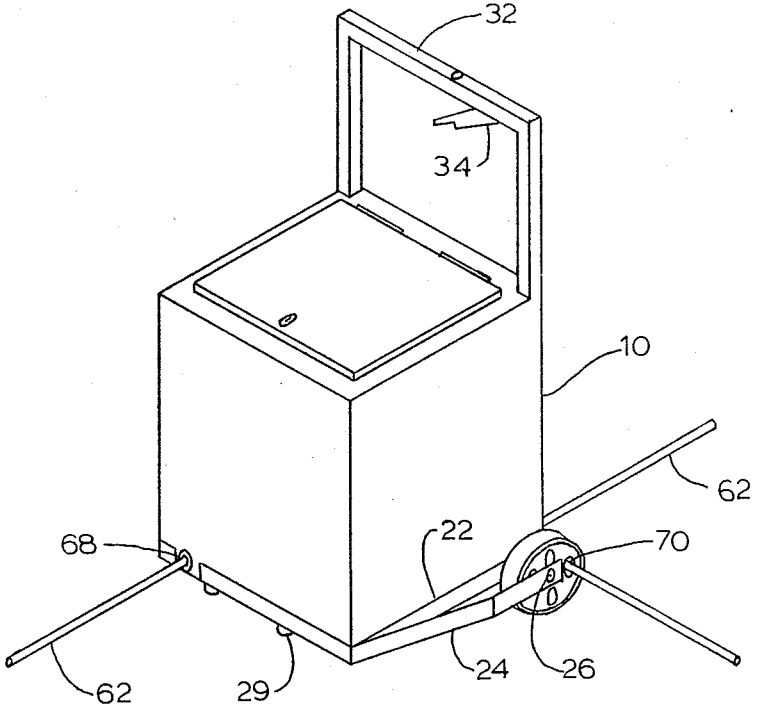
FIG. 2 is a perspective view of the embodiment of FIG. 1 with the antitheft mechanism shown in the actuated position.
Figure 6:
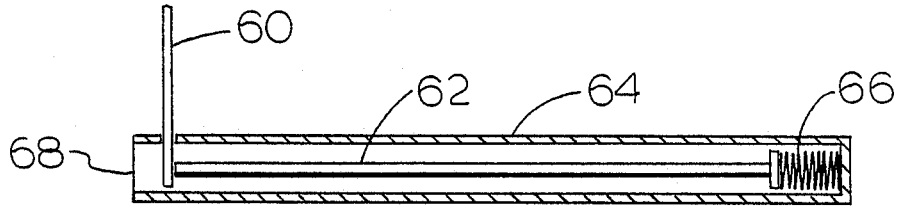
FIG. 6 is a detailed view of one embodiment of a rigid, rod-like projection constituting a portion of the antitheft mechanism.

As shown in FIG. 6, each actuator rod, when the actuator rods are in the position shown in FIG. 4, engages the end of a an elongated cylindrical housing 64 having at one end thereof opposite actuator rod 60 a compressed spring 66 which is adapted to bias the projection rod 62 longitudinally toward actuator rod 60. The end of the cylindrical housing 64 opposite that of spring 66 is open. With the handle 34 in the gripped position, the actuator rod 60 is in the position shown in FIG. 6. With the handle 34 in the ungripped position, which is the position shown in FIGS. 3 and 5, the actuator rod is moved longitudinally and upward as viewed in FIGS. 5 and 6 to a position out of contact with the end of the projection rod 62 and the end of its associated cylindrical housing 64. The open end of the cylindrical housing 64 opens through the container 12 of the strongbox through openings 68 near the base thereof, as shown in FIGS. 1 and 2. With the lever 34 in the gripped position the rods remain retracted within the cylindrical housing 64 and the device is as shown in FIG. 1. With the lever 34 being in the ungripped position, the projection rods move rapidly from the retracted position to a radial extended position outside the perimeter of the strongbox as shown in FIG. 2. Wheels 28 of the dolly are provided with a plurality of openings 70 that coincide with an opening 68 thus permitting two projection rods 62 when in the extended positions to extend through these openings to prevent rotation of the wheels, as shown in FIG. 2.

As shown in FIG. 3, the handle 32 has a key-operated latch mechanism designated generally as 72. The mechanism 72 has a tumbler 74 rotatably connected at one end to a key plate 76 having an opening (not shown) through which a key extends to rotate the tumbler 74. The tumbler 74 at the opposite end from the key plate 76 is connected to a latch bar 78. The latch bar 78 may be rotated by operation of the key and associated tumbler 74 to the position shown in FIG. 3 which brings it into engagement with a notch 80 on the lever 34 when the lever 34 is in the gripped position. In this manner, the lever 34 may be maintained in this position without requiring gripping. In this manner, the antitheft mechanism, is disarmed. Correspondingly, when the latch bar 78 is rotated out of engagement with the notch 80 in the lever 34, the lever 34 will then pivot to the position shown in FIG. 3 if it is ungripped.

In the operation of the device, the lid 14 may be raised to load valuables into the interior of the container 12 of the strongbox device. Upon loading the lid is closed and locked by key operated lock 18. During this operation, the lever 34 associated with handle 32 is in the raised position substantially parallel with the handle 32 and is maintained in this position by the latch bar 78 being in engagement with the notch 80 at the end of the lever 34. With the lever 34 in this position, the pivot links 42 and 44 and associated lift bar 48 are in the positions shown in FIG. 4. In addition, the actuator rods 60 are in the positions shown in FIG. 6. Consequently, the projection rods 62 are maintained within the cylindrical housings 64 against the bias of springs 66, which is the position as shown in FIG. 6.

After loading of the valuables, the attendant grips the handle 32 and associated lever 34 and then uses a key to operate the mechanism 72 to rotate the latch bar 78 thereof out of contact with the notch 80 at the end of the lever 34. This arms the antitheft mechanism. The device may then be moved by the use of wheels 28 in the normal manner of operating a dolly. As long as the lever 34 is maintained in the gripped position substantially parallel with the handle 32 by the operator the device is as shown in FIG. 1.

If, however, the attendant is accosted and releases his grip on handle 32 and associated lever 34, the lever 34 will be then moved to the position shown in FIG. 3 by the bias of spring 38. The cable 40 will be correspondingly raised to act on the pivot links 42 and 44 to pivot them to the position shown in FIG. 5. The normally compressed springs 54 act against lift bar 48 to move it upwardly as viewed in the drawings to the position shown in FIG. 5. The associated actuator rods 60 are also raised. This causes the actuator rod ends normally engaging the end of projection rod 62 within the cylindrical housing 64, as shown in FIG. 5, to move out of engagement with the projection rod ends. This causes, by the action of springs 66, the rods to move rapidly longitudinally through the openings 68 in the container 12 and two of the rods also extend through the openings 70 in the wheels 28 as shown in FIG. 2. In the embodiment shown in the drawings four projection rods are used. Two of the rods extend through the openings in the wheels to lock the wheels and the remaining two rods extend from the other two sides of the container 12. In this manner, the rods not only prevent the wheels from being rotated and thus impair movement of the strongbox but the extension of the rods prevents the strongbox from being moved through doorways and stairways.

Figure 7:
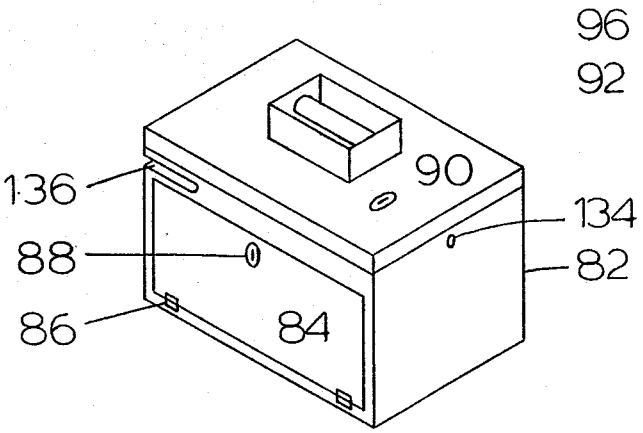
FIG. 7 is a perspective view of a second embodiment of the invention.

An alternate embodiment of the invention is shown in FIGS. 7–13. This embodiment is a smaller, lighter weight strongbox that is carried by an attendant rather than being transported by a dolly in accordance with the first embodiment of the invention. As shown in FIG. 7, the strongbox designated generally as 82 is of generally rectangular cross section and has a door 84 that is connected to the strongbox by hinges 86. The door 84 has a key operated lock 88. The door 84 provides entry to the interior of the strongbox 82 for purposes of loading and unloading valuables.

Figure 8:
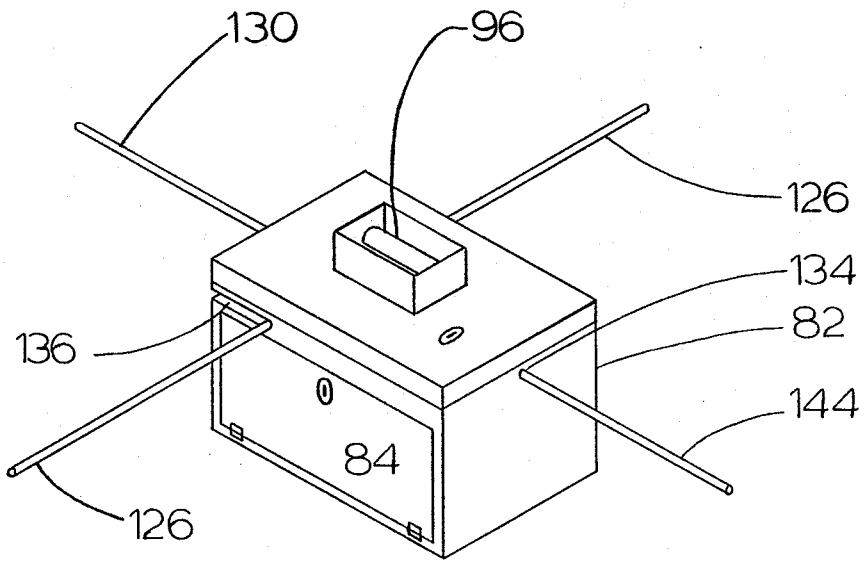
FIG. 8 is a view similar to FIG. 7 showing the antitheft mechanism in the actuated position.
Figure 9:
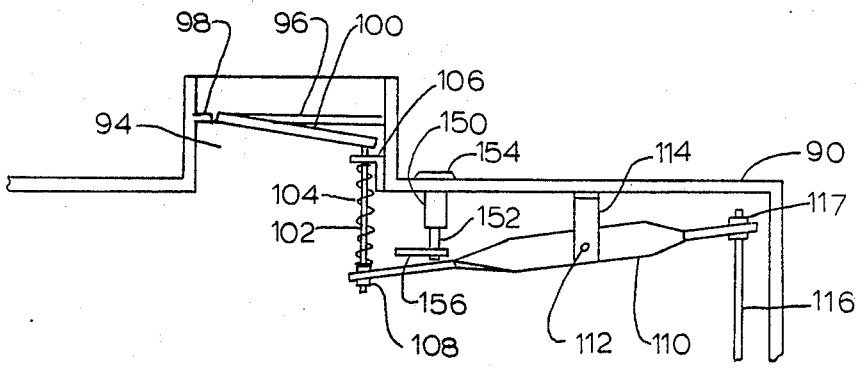
FIG. 9 is a detailed view showing the manually operable lever and associated mechanism for operating the antitheft mechanism.

The strongbox 82 also has a rectangular housing 90 on the top thereof, which housing contains the antitheft mechanism in accordance with the invention. As shown in FIGS. 7, 8 and 9, the housing 90 has an upstanding, four-sided enclosure 92 defining a rectangular opening 94 to the interior of the housing 90. The enclosure 92 also serves as a mounting for carrying handle 96, which is used for carrying the strongbox. Pivotally connected to the handle 96 at pivot connector 98 is a lever 100. The end of the lever 100 opposite that connected to pivot connector 98 is attached to a spring retainer rod 102 around which spring 104 is mounted. Rod 102 slidably extends through tab 106 to its connection with the lever 100. The opposite end of rod 102 is connected by nut 108 to an end of a pivot lever 110 that is pivotally mounted at pivot connector 112 to a bracket 114 connected to the housing 90. The opposite end of the lever 110 is connected to a actuator pin 116 by nut 117. The pin 116 slidably exends through a support block 118 connected to the housing interior and through an opening 120 in slidable, projection rod mounting plate 122. Plate 122 has connected pivotally by pivot connector 124 a pair of identical projection rods 126. The ends of projection rods 126 opposite their pivotal connection to the plate 122 are each confined between a pair of identical rod-shaped upstanding stops 128. An additional projection rod 130 is attached by connector 132 to the plate 122 at a location generally midway between the connectors 124 for the rods 126. The opposite end of the rod 130 from its attachment 132 is at an opening 134 through the housing 90. Elongated openings 136 are also provided in the housing at opposite sides thereof corresponding to the free ends of the rods 128.

Figure 10:
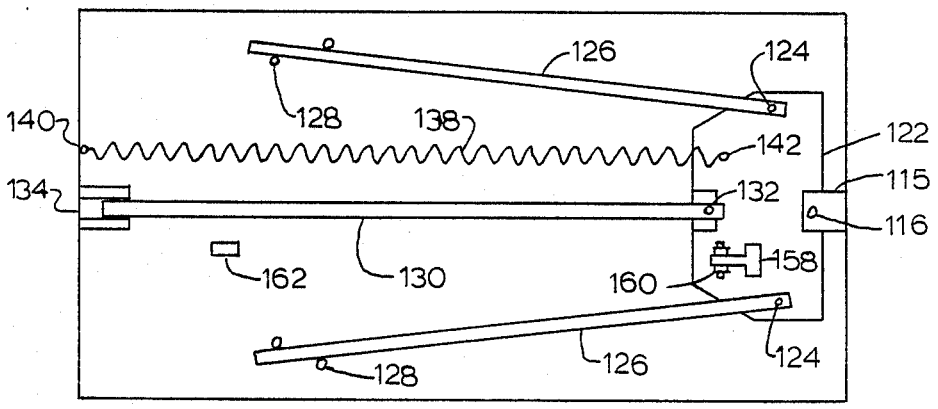
FIG. 10 is a detailed view showing the rigid, rod-like projections in their normal deactivated position.
Figure 11:
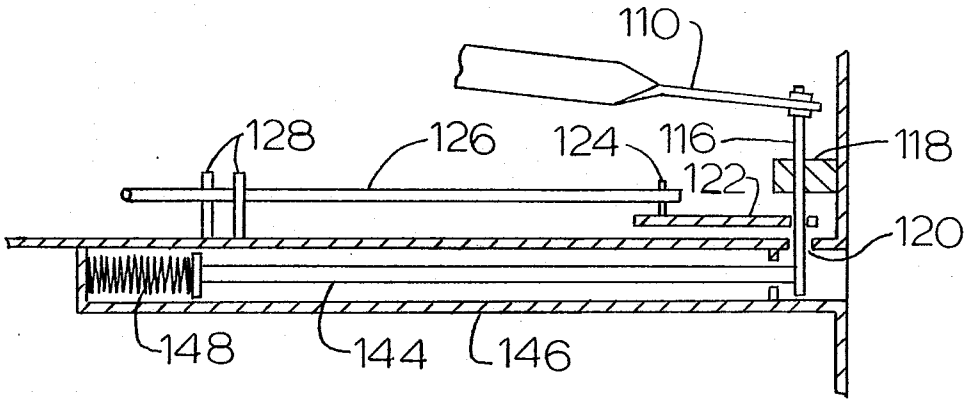
FIG. 11 is an additional detailed view of the mechanism of FIG. 10.
Figure 12:
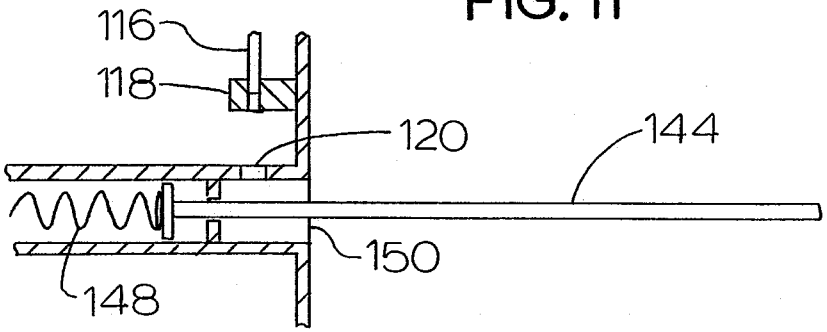
FIG. 12 is a detailed view of a telescoping bar constituting one rigid, rod-like projection of the antitheft mechanism.

A spring 138 extends along the length of the housing and is connected to the housing interior by connector 140 and at its opposite end to the plate 122 by connector 142. The spring 138 biases the plate 122 in a longitudinal direction with respect to the housing interior and the rod 130. The trigger pin 116 when in the position shown in FIG. 11 maintains the plate 122 in the position shown in FIGS. 10 and 11 against the bias of spring 138. A fourth projection rod 144, as shown in FIGS. 11 and 12, is mounted beneath the plate 122 within a cylindrical housing 146. A spring 148 is in one end of the housing and urges the rod 144 in a longitudinal direction toward opening 150 in the housing 146. As shown in FIG. 11 with the pin 116 in position as shown in this figure, the rod 144 is retained within the housing and against the force of spring 148. The pin 116 when in this position is in contact with the end of the rod 144 opposite the end in contact with the spring 148.

A key operated latching mechanism 150 is provided in the housing 90 and has a tumbler 152 connected between a key plate 154 having a key hole for inserting a key to rotate tumbler 152. The end of tumbler 152 opposite that connected to the key plate has attached thereto a latch bar 156. The latch bar 156 is adapted for rotation by means of a key to bring the latch bar 156 into contact with the bottom of lever 110.

A latch 158 is connected by hinges 160 to plate 122 and extends through an opening (not shown) in the plate. The latch is adapted to mate with a slot 162 upon actuation of the device.

In the operation of the device, the key mechanism 150 is operated to bring the latch bar 156 into a position beneath the lever 110. This pivots the lever and moves associated spring retainer rod 102 upwardly as viewed in FIG. 9 to bring the hand grip lever 100 into engagement with the handle 96. The lever 110 pivots about pivotal connection 112 in a clockwise direction. This positions pin 116 in the position shown in FIG. 11. The antitheft mechanism is in this manner disarmed to permit loading and unloading of valuables into the strongbox through the door 84. When the strongbox has been so loaded and is to be transported the key mechanism 150 is operated by the attendant by the insertion and rotation of a key to bring the latch bar 156 out of engagement with the lever 110. While so doing, the attendant grips the handle 96 and the associated hand-operated lever 100 to mainain the antitheft mechanism in the deactivated mode. Consequently, the lever 110 and associated pin 116 are maintained in the position shown in FIG. 11. The rods 126, 130 and 144 are, therefore, in the positions as shown in FIGS. 10 and 11.

Figure 13:
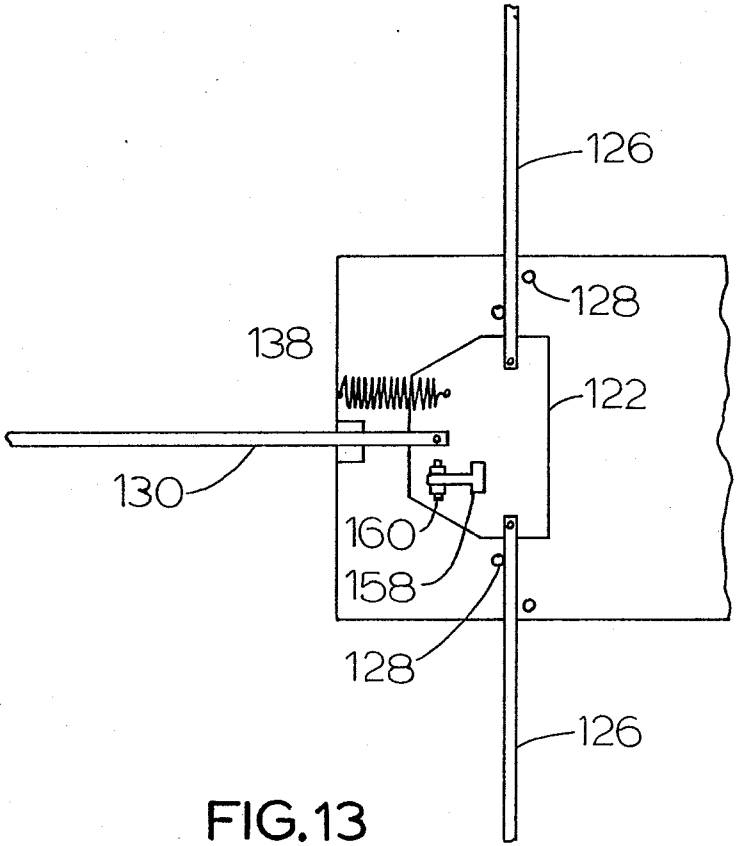
FIG. 13 is a detailed view of the rigid, rod-like projections of the antitheft mechanism in their radial, extended position upon actuation of the antitheft mechanism.

The strongbox is then ready to be transported by the attendant. As long as the attendant grips the handle 96 and associated hand-operated lever 100, the antitheft mechanism remains deactivated and the rods 126, 130 and 144 are in the positions shown in FIGS. 10 and 11. If, however, the attendant is accosted by a robber and is made to release the handle 96 this causes the hand-operated lever 100 to move away from the handle 96 and pivot downwardly about pivot connection 98 to the position shown in FIG. 9. The spring 102 then acts against the end of the lever 110 to which the spring and the spring retainer 102 are connected to pivot the lever 110 about pivotal connection 112. This causes the pin 116 connected to the opposite end of the lever 110 from that to which the spring and retainer are connected to be raised upwardly as the lever 110 is pivoted or rotated in the counterclockwise direction. As the pin 116 is raised the plate 122 is released, as shown in FIG. 13 and by the action of spring 138 is rapidly moved longitudinally along the housing. In addition, the raising of pin 116 by the rotation of the lever 110 in the counterclockwise direction causes the pin to be disengaged from the end of rod 114 and thus spring 148 rapidly moves this rod 144 through the opening 120 and to the position shown in FIG. 12. The movement of the plate 122 causes rods 128 to pivot and extend through elongated openings 136. The rod 130 as a result of the movement of plate 122 is moved longitudinally through opening 134 in the housing. This simultaneous movement or projection of the rods as shown in FIGS. 12 and 13 causes the rods 126, 130 and 144 to project exteriorally of the housing of the strongbox to result in the configuration shown in FIG. 8. Latch 155 on plate 122 enters slot 162 to fix the plate 122 and associated projection rods 126 and 130 in their projected positions. The projection of these four rods in radial relation to the strongbox prevents the strongbox from being lifted and transported readily through doorways and along stairways and the like.

Figure 14:
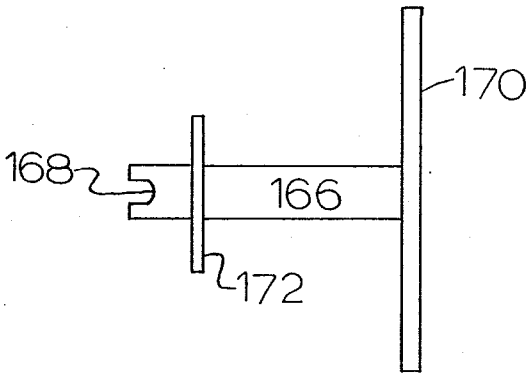
FIG. 14 is a plan view of a tool for use in resetting or rearming the antitheft mechanism.

As shown in FIG. 14, the tool 164 for use in resetting the antitheft mechanism has a rod 166 with a notch 168 at one end and a handle 170 at the opposite end. A stop collar 172 is rigidly connected between its ends. The distance between the stop collar and the notched end of the rod substantially corresponds to the distance between the container exterior and the actuator rod axis. The diameter of the rod 166 substantially corresponds to the diameter of the projection rods.

In resetting the antitheft mechanism of the first embodiment, the lever 34 is held by latch bar 78 in the horizontal, disarmed position as earlier described. Pivot links 42 and 44 and associated lift bar 48 are returned to the position shown in FIG. 4. This compresses springs 54 and causes actuator rods 60 to bear against the associated, extended projection rods 62. The notched end of the resetting tool 164 is then pushed against the projecting end of a rod 62 with the notch 168 vertically positioned. The rod 62 is pushed into its housing. When the collar 172 of the resetting tool reaches the container exterior, the notch is aligned with the end of the associated actuator rod and the actuator rod then slides through the notch to contact and restrain the projection rod against the bias of spring 66. This sequence is repeated for each projection rod.

The identical resetting tool is used for resetting the mechanism of the second embodiment. Latch 158 is moved on hinges 160 from slot 162. Lever 100 is maintained in the raised position and the resetting tool is used push projection rods 130 longitudinally to cause rods 126 to retract with movement of mounting plate 122 to the position shown in FIG. 10. In this position, pin 116 slides through support block 118 and into opening 120 in the mounting plate, thereby retaining the plate in this position as earlier described. The resetting tool is then used to reset projection rod 144 in the manner as described with respect to the first embodiment so that pin 116 is caused to engage the end of rod 144 to retain it within its housing against the bias of spring 148.

Although the invention has been described with respect to embodiments showing a strongbox of a generally rectangular cross section this may be varied depending upon particular applications. In addition, the projecting rods may be used in any desired number likewise depending upon the particular application. The actuating mechanism for the projecting rods may also be adapted to actuate an alarm mechanism such as an audible alarm like a siren or bell.

In the first embodiment of the dolly arrangement for the strongbox, apparatus may be provided for loading and unloading the device from an armored car interior or the like. This may be achieved by a manually operated winch connected to the armored car interior. The key for arming and disarming the antitheft mechanism located in the handle may also be connected to the interior of the armored vehicle so that the key remains in the mechanism to deactivate it during loading and unloading and thereafter may be removed by the operator to arm the antitheft device during transport from the vehicle to a safe room where the valuables are to be deposited. The antitheft mechanism of the invention is of uncomplex and economical construction and lends itself to various modifications depending upon particular security applications.

What is claimed is:

1. A strongbox having an integral antitheft mechanism, said strongbox comprising a container having an interior adapted for storing valuables, a lid for selectively opening and closing of said container interior, a locking means associated with said lid and adapted to lock said lid in a closed position, at least one rigid, rod-like projection having a normal retracted position within a perimeter of said strongbox, actuating means for rapid movement of said projection from said retracted position to a radial, extended position beyond said strongbox perimeter and a dolly integral with said strongbox, said dolly having a pair of wheels and at least one said projection being adapted to extend through an opening in at least one wheel when in the extended position to prevent rotation of said wheel.

2. The strongbox of claim 1 having manually operable means for activating said actuating means.

3. The strongbox of claim 2 wherein said manually operable activating means is a hand-held lever which when released from a hand-held, depressed position activates said actuating means to result in said rapid movement of said projection from said retracted position to said radical, extended position beyond said strongbox perimeter.

4. The strongbox of claim 3 wherein latching means are provided for selectively maintaining said hand-held lever in said depressed position.

5. The strongbox of claim 4 wherein said latching means are selectively activated by a key.

6. A strongbox having an integral antitheft mechanism, said strongbox comprising a container having an interior adapted for storing valuables, a lid for selectively opening and closing of said container interior, a locking means associated with said lid and adapted to lock said lid in a closed position, a plurality of rigid, rod-like projections having a normal, retracted position within a perimeter of said strongbox, actuating means for rapid movement of said projection from said retracted position to a radial, extended position beyond said strongbox perimeter, a hand-held lever which when released from a hand-held, depressed position activates said actuating means to result in said rapid movement of said projections from said retracted position to said radial, extended position beyond said strongbox perimeter and a dolly integral with said strongbox, said dolly having a pair of wheels and at least one said projection being adapted to extend through an opening in at least one wheel when in the extended position to prevent rotation of said wheel.

7. The strongbox of claim 6 wherein latching means are provided for selectively maintaining said hand-held lever in said depressed position.

8. The strongbox of claim 7 wherein said latching means are selectively activated by a key.

9. The strongbox of claim 6 wherein said hand-held lever is attached to said lid.

10. The strongbox of claim 9 wherein said hand-held lever is in hand-held relation to a carrying handle attached to said lid.

11. The strongbox of claim 6 wherein said dolly has a handle extending from said container and said hand-held lever is attached to said handle.

12. A strongbox having an integral antitheft mechanism, said strongbox comprising a container having an interior adapted for storing valuables, a lid for selectively opening and closing of said container interior, a locking means associated with said lid and adapted to lock said lid in a closed position, a plurality of rod-like projections having a normal retracted position within a perimeter of said strongbox and actuating means for rapid movement of said projections from said retracted position to a radial, extended position beyond said strongbox perimeter, said actuating means including a hand-held lever which when released from a hand-held, depressed position operates mechanical linkage connected between said lever and spring means associated with said projections to spring actuate said projections to produce said rapid movement of said projections from said retracted position to said radial, extended position, said mechanical linkage including a pivotally mounted lever having one end connected to said hand-held lever and an opposite end connected to means for retaining said projections in said retracted position and means for pivoting said pivotally mounted lever in response to release of said hand-held lever to cause said retaining means to release said projections from said retracted position.

13. The strongbox of claim 12 wherein said retaining means includes a pin connected to said pivotally mounted lever and to said spring means.

14. The strongbox of claim 13 wherein at least one of said projections is adapted for movement from said retracted position to said radial, extended position by pivoting about a connection at an end thereof.

* * * * *